United States Patent [19]

Link

[11] 4,172,245

[45] Oct. 23, 1979

[54] ADJUSTABLE TRANSFORMER

[75] Inventor: Edwin A. Link, Waukesha, Wis.

[73] Assignee: RTE Corporation, Waukesha, Wis.

[21] Appl. No.: 830,641

[22] Filed: Sep. 6, 1977

[51] Int. Cl.[2] ..... H01F 27/30

[52] U.S. Cl. ..... 336/197; 29/606; 336/210; 336/217

[58] Field of Search ..... 336/216, 217, 234, 210, 336/197; 29/606, 609

[56] References Cited

U.S. PATENT DOCUMENTS

| | | | |
|---|---|---|---|
| 508,422 | 11/1893 | Hornberger | 336/217 |
| 1,145,551 | 7/1915 | Burke | 336/217 |
| 2,293,951 | 8/1942 | Seastone et al. | 336/216 |
| 2,467,824 | 4/1949 | Granfield | 336/217 X |
| 3,153,215 | 10/1964 | Burkhardt et al. | 336/217 |
| 3,290,633 | 12/1966 | Kuriyama et al. | 336/217 X |
| 3,374,453 | 3/1968 | Broverman et al. | 336/210 X |

*Primary Examiner*—Thomas J. Kozma
*Attorney, Agent, or Firm*—Ronald E. Barry

[57] ABSTRACT

An adjustable transformer core and the method of manufacturing an adjustable transformer core, the transformer including a core and coils, the core being formed from a plurality of lamination sets, each lamination set including a number of legs and a pair of yoke members, the lamination sets being stacked in face-to-face relation so that the legs can be moved relative to each other. The coils may be wound directly on the legs and are moved toward each other to obtain predetermined characteristics. The coils are enclosed within a pair of core clamps to retain the relative position of the coils. Such adjustment can be employed to obtain different impedance or insulation levels. It is also within the contemplation of this invention to use the core as a common core for a variety of transformer designs.

The method of manufacture may include the steps of providing a plurality of lamination sets with coils wound on the legs of the lamination sets, applying force to the coils to move the coils within the lamination sets and enclosing the lamination sets and coils within a set of clamps and a set of pads to maintain the position of the coils, and mounting the transformer assembly in a housing which is adjustable to the size of the core and coils.

7 Claims, 10 Drawing Figures

ADJUSTABLE TRANSFORMER

BACKGROUND OF THE INVENTION

Three phase transformers generally include a laminated core and a number of preformed coils mounted on the legs of the core. The core is formed from a plurality of fixed lamination sets which are alternately arranged to provide magnetic continuity throughout the core. The coils which are mounted on the legs of the core cannot be adjusted once they are mounted on the legs of the core.

SUMMARY OF THE INVENTION

The three-phase adjustable transformer according to the present invention has superior short circuit capability, reduced size and is less expensive to manufacture. The transformer includes a laminated core which is formed from a plurality of lamination sets each lamination set having at least three legs and two yoke members. The coils may be wound directly on the preassembled legs thereby reducing take-up so that solid material makes up the section through each leg and coil and eliminates the necessity of having slip fits. The coils and legs are then assembled on a fixture and the yoke members positioned at the top and bottom of each set of legs and coils. The lamination sets can be stacked in a number of staggered relations so that the legs are free to move laterally relative to each other. Since the lamination sets are staggered, magnetic integrity is maintained. The coils are subjected to a compressive force to compress the sides of the coils and provide a substantially solid mass through the core and coil assembly. The compressive force reduces the size of the transformer making it possible to house the transformer in a smaller housing and thereby reduce the oil requirements.

DRAWINGS

DESCRIPTION OF THE INVENTION

Figure 1:
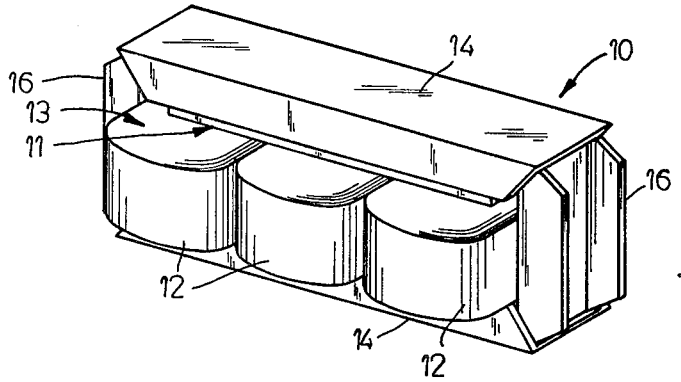
FIG. 1 is a perspective view of the transformer according to the present invention.

The transformer 10 according to the present invention and as shown in FIG. 1 includes an adjustable core and coil assembly 13 having a number of coils 12 mounted on a core 11 and held together by core clamps 14 and pressure pads 16.

Figure 2:
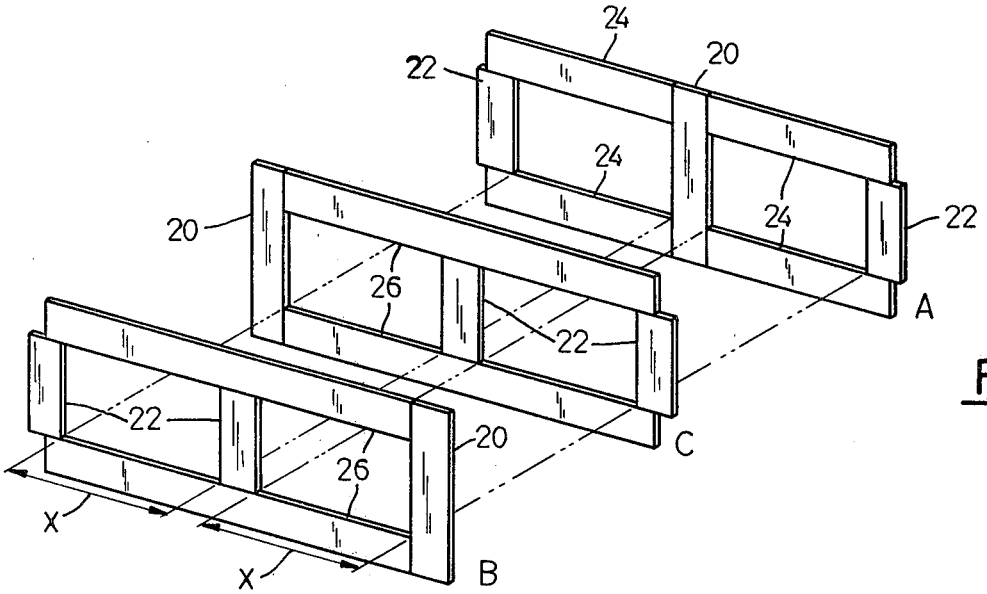
FIG. 2 is a perspective view of three lamination sets having one long leg and two short legs in each set.
Figure 3:
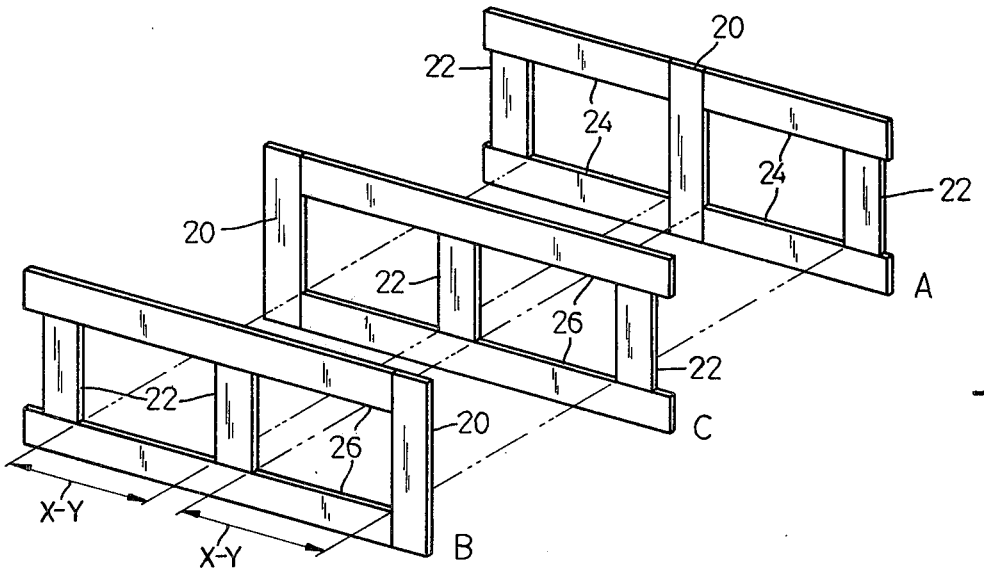
FIG. 3 is a perspective view of the lamination sets of FIG. 2 showing the two short legs of each lamination set moved relative to the long leg in each set.

In accordance with the invention the adjustable core 11 is formed from a plurality of lamination sets A, B, C as seen in FIGS. 2 and 3. As seen in FIG. 2, the lamination set A is formed from a single long leg 20, a pair of short legs 22 and a number of yoke members 24. The lamination set A is completed by aligning yoke members 24 with the legs 20 and 22. In set A the two short legs 22 are free to move relative to the long leg 20 and yoke members 24 as seen in FIG. 3.

Lamination set B includes a long leg 20 and a pair of short legs 22. The long leg 20 is located at the end of a pair of yoke members 26. In lamination set B the two legs 22 are free to move relative to the long leg 20 and yoke members 26 as seen in FIG. 3. Lamination set C is similar to lamination set B and includes a long leg 20, two short legs 22 and a pair of yoke members 26. The two short legs 22 are free to move relative to the long leg 20 and yoke member 26 as seen in FIG. 3. However, in lamination set C the long leg 20 is located at the opposite end of the lamination set than in set B.

Figure 4:
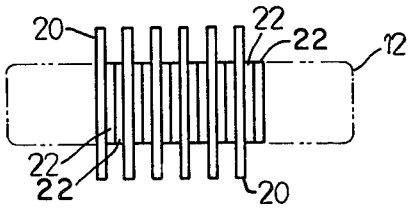
FIG. 4 is an end view of one of the legs of the stacked core with the coils shown in phantom wrapped around the leg.
Figure 5:
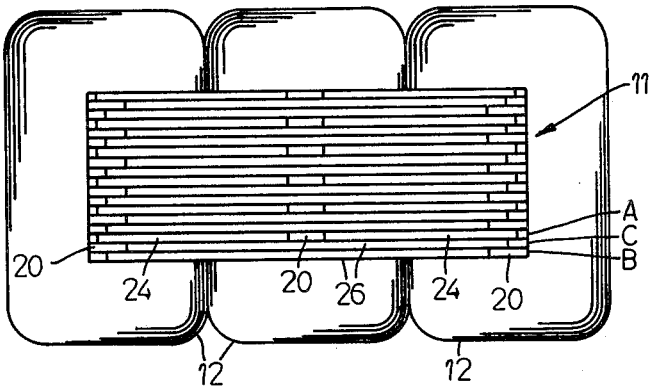
FIG. 5 is a top view of the transformer with the coils wound on the legs of the core prior to compression.

Prior to assembling lamination sets A, B and C to form the core, the legs are stacked in a fixture independently so that the legs are offset as seen in FIG. 4. The coils 12 are wrapped directly on the legs. Referring to FIG. 4, one of the coils 12 is shown wrapped or wound directly onto one of the legs for the core. The preassembled coils and legs which are mounted in a fixture are completed by placing the corresponding yoke members 24 and 26 for the various lamination sets at the top and bottom of the coils to complete the assembly 11.

After assembly, the core clamps or U-clamps 14 are placed on the yoke members 24 and 26. Pressure pads 16 are positioned at each end of the outside coils 12. A compressible force is then applied to the pressure pads 16 to compress the coils tightly against each other within the core. The compressive force can be applied by means of any conventional, mechanical, hydraulic clamp of sufficient size to compress the coils. This compressive force will cause the legs 20 and 22 in each of the lamination sets to move relative to the other legs allowing the coils to be compressed into tight engagement with each other. In this regard it should be noted that since the short legs 22 and long legs 20 have been arranged in the order as shown in FIGS. 2 and 3, the short legs 22 in each set can move relative to the yoke members 24 and 26. However, as seen in FIGS. 2 and 3, the long legs 20 in set A and the yoke members 24 in set A cannot move. In lamination sets B and C the short legs 22 can move relative to the long end leg 20. Since the center coil 12 is wrapped around all of the center legs, the net effect of the compressive force is to move the outer coils 12 toward the center coil.

In large transformer assemblies, relative movement between the yoke laminations and leg laminations may not be possible due to the high frictional forces present. If this condition does exist, then the core and coil assemblies should be assembled by the following method:

Preassemble the coils on the stacked leg laminations. Position the assembled coil leg assembly in a compression jig and compress with the compression pads as described above. The leg laminations will then be in the final assembled position. The top and bottom yoke laminations can then be fitted by hand and tapped in position with a mallet. The core clamps are then fastened in place while the assembly is compressed.

Figure 6:
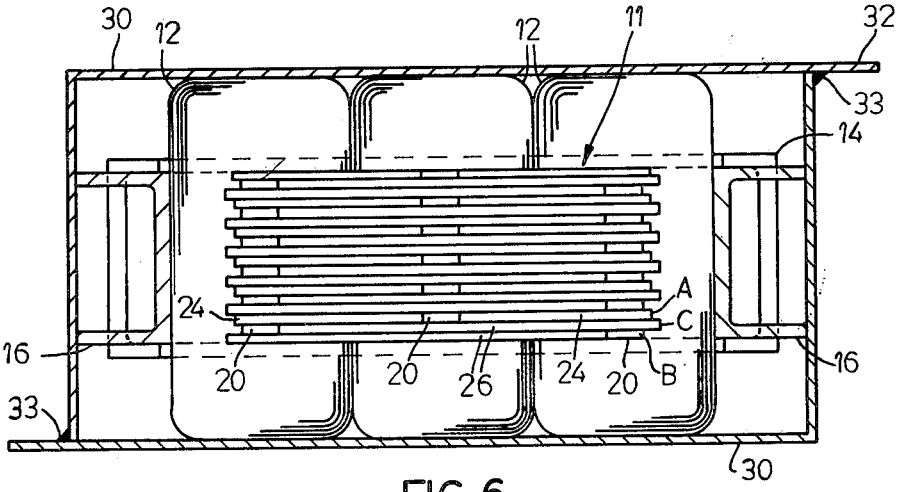
FIG. 6 is a top view of the transformer shown in FIG. 5 showing the coils after being subjected to a compressive force and the adjustable side walls of the transformer housing positioned against the core and coil assembly.
Figure 7:
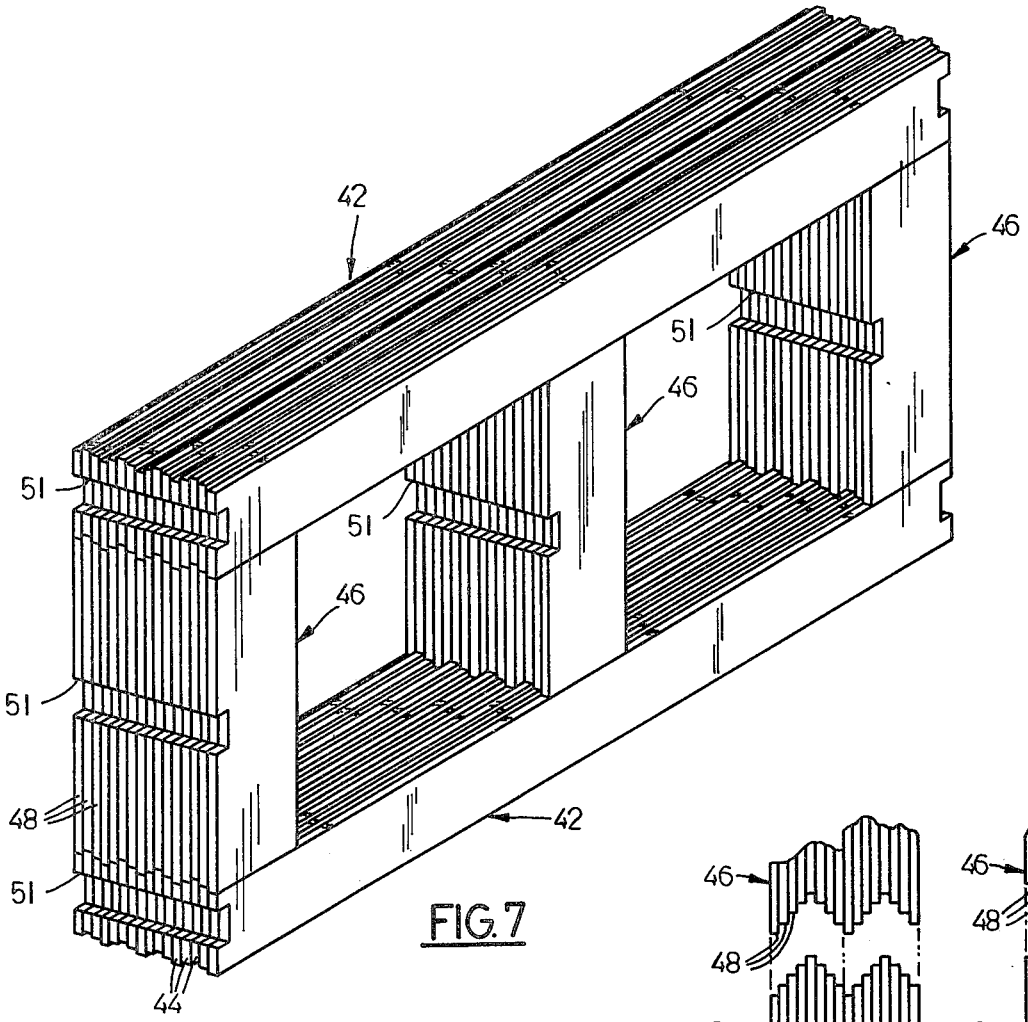
FIG. 7 is a perspective view of another form of adjustable core for the transformer according to the invention.

The amount of reduction in size of the core and coil assembly due to the application of the compressive force to the outer edges of the coils will vary from one coil and core assembly to another. In order to take advantage of this reduction in size of the core and coil assembly, a transformer housing can be used which is formed from two L-shaped side wall sections 30 as seen in FIG. 6.

In this regard, it should be noted that the side wall sections 32 of the L-shaped walls 30 extend beyond the ends of the end wall sections 34. The walls 30 can be positioned in tight engagement with the core and coil assembly and welded at 32 to the exact size of the core and coil assembly. With this arrangement, the amount of oil required to insulate the core and coil assembly can be minimized to the exact size of the housing required for the core and coil assembly.

In FIGS. 7 through 10, another form of adjustable core and coil assembly 40 is shown. In this embodiment of the invention, the adjustable laminated core is formed from a pair of yoke members 42 and a number of legs 46. Means are provided to allow all of the legs 46 to move in a fixed path with respect to the yoke members 42. Such means is in the form of a number of corresponding butt lap joints or staggered grooves provided between the ends of the legs and the edges of the yoke members.

Figure 9:
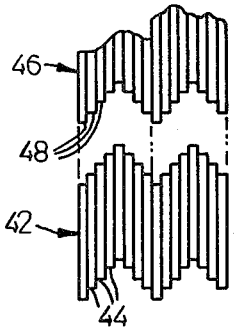
FIG. 9 is an end view of one form of V-groove arrangement for the legs and yoke members of FIG. 7.

In this regard it should be noted that the yoke members 42 are formed from a plurality of laminations or strips 44 and the legs are formed from a plurality of laminations or strips 48 of equal length. The butt lap joints, as seen in FIG. 9, are formed by staggering the laminations or strips 48 in the legs 42 lengthwise. This is accomplished by assembling the strips 48 in a fixture prior to winding the coils 50 on the legs 46. The laminations or strips 44 for the yoke members are then stacked on the staggered ends of the legs 46 to stagger the strips 44 widthwise that they assume the corresponding position of the legs.

Means can be provided for maintaining the relation of the strips 48 and 44 during assembly. Such means is in the form of a number of grooves or slots 51 provided in the ends of yoke members 42 and the sides of legs 46.

Figure 10:
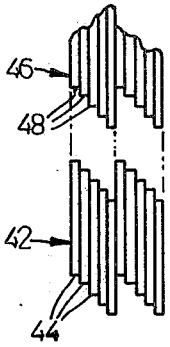
FIG. 10 is an alternate form of groove arrangement for the legs and yoke members of FIG. 7.

An alternate means for forming the butt lap joints or grooves in the legs and yoke members is shown in FIG. 10. In this arrangement the strips 48 for the legs 46 are stacked in identical staggered or offset relation. The strips 44 are then stacked in the ends of the legs 46 to form the corresponding groove. The legs 46 are thereby supported between the yoke members 42 by offsetting the grooves of the legs with the grooves of the yoke members. The legs are then free to move in a fixed path in the grooves of the yoke members relative to each other.

Figure 8:
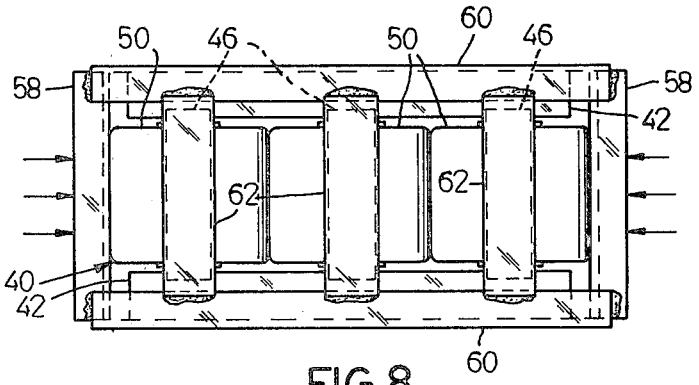
FIG. 8 is a side view in elevation of the transformer according to the invention having an adjustable core as shown in FIG. 7.

As seen in FIG. 8, when the coils 50 are wrapped on the legs 46 and the legs are aligned with the yoke members 42, the coils can be compressed by applying force to each end of the core. In this regard, pressure pads 58 are positioned at each end of the yoke members 42 and U-clamps 60 are arranged on the top and bottom yoke members 42. Force is applied to the pressure pads 60 to compress the coils. After the coils have been compressed, the pressure pads are welded to the U-clamps and straps 62 are welded to the U-clamps to hold the U-clamps in position.

This core provides the advantage of requiring only two size laminations. The yoke laminations are of the same length and the leg laminations are of the same length. The butt lap joints formed at the end of the legs and on the sides of the yoke members allows for sliding movement of the legs relative to each other to allow for compression of the yokes after the coil core assembly has been assembled. After compression, the coil and core assembly can be housed in a transformer housing as described above.

The three phase transformer according to the present invention is formed by the following process. A plurality of generally flat, metal lamination sets are provided which are stacked to define a transformer core, each lamination set including three legs and a number of yoke members with the legs being arranged to be moved relative to each other in the yoke members.

A coil is provided on each of the legs by either initially wrapping the coil directly onto a preassembled leg or by mounting the coil on the leg after the laminations have been stacked.

If the coils are mounted on the stacked legs prior to assembly into the lamination sets, the preassembled coils and legs are mounted in a fixture and the yoke members are then placed at the top and bottom of the coils.

Core clamps are placed on the top and bottom yokes of the transformer core and pressure pads are placed at each end of the core and coil assembly in engagement with the outside surface of the outer coils.

The core and coil assembly is adjusted by applying and holding a force against the pressure pads to move the coils inwardly toward the center leg or center coil.

The pressure pads are then secured to the core clamps either by welding or by any other appropriate means to maintain the position of the coils. After welding, the force is released from the pressure pads. The transformer is completed by placing L-shaped housing side walls around the outer perimeter of the core and coil assembly and in abutting engagement therewith, the L-shaped side wall sections then being welded at the corners. The housing is completed by securing a bottom panel and a top panel to the side walls.

Resume

The adjustable core and coil assembly of the present invention can be employed to obtain different electrical and mechanical performances as well as different impedance or insulation levels. Oil requirements are reduced by using an adjustable casing to enclose the core and coil assembly. The staggered relation of the yoke and leg laminations provides a relatively slideable relationship of low reluctance.

The embodiments of the invention in which an exclusive property or privilege is claimed are defined as follows:

1. A transformer comprising:

a laminated core formed from a plurality of stacked lamination sets, each lamination set including three legs and top and bottom yoke members, at least two of the legs in each set being free to move relative to the yokes, a coil mounted on each of the legs of the laminated core, and means to move the laminated legs relative to the yoke to compress the coils.

2. A transformer coil and core assembly comprising a laminated core having a plurality of legs which are free to move relative to each other and to yoke members, a coil mounted on each of said legs, and means compressing said coils on said moveable legs against each other to maintain a compressive force on said coils by the application of force to the core coils.

3. A three-phase transformer comprising:

a laminated core formed from a plurality of lamination sets stacked to define a transformer core, each lamination set including three legs arranged in a parallel spaced relation and a yoke member positioned at the top and bottom of said legs, means allowing for movement of the legs in a fixed path relative to the yoke members, a coil mounted on each of the legs, the coils being free to move with the corresponding legs relative to the yokes when subjected to a compressive force, and means to move said legs to compress the coils after assembly.

4. The transformer according to claim 3 including means for enclosing the yokes and coils to maintain the compressive force on the coils.

5. The transformer according to claim 3 wherein each lamination set includes two legs having a length equal to the distance between the yoke members and one leg having a length equal to the distance between the outside of the yoke members.

6. A transformer assembly having an adjustable core, said transformer including a plurality of metal laminations forming a pair of yoke members, a plurality of metal laminations forming a number of legs moveable with respect to said yoke members, a coil mounted on each leg, said legs being mounted between said yokes in a parallel spaced relation, a pad at each end of the core in a position to compress the coils, a core clamp on each yoke member, said pads being secured to said core clamps after said coils have been compressed against each other by movement of said legs, whereby the voids between the coils are eliminated.

7. The transformer assembly according to claim 6 including means for enclosing said core and coil assembly to confine it in a minimum space.

* * * * *